US005593151A

United States Patent [19]

Mashtare et al.

[11] Patent Number: 5,593,151

[45] Date of Patent: Jan. 14, 1997

[54] SELF BIASING ELECTROSTATIC PAPER TRANSPORT

[75] Inventors: Dale R. Mashtare, Macedon; Christopher Snelling, Penfield, both of N.Y.

[73] Assignee: Xerox Corporation, Stamford, Conn.

[21] Appl. No.: 358,500

[22] Filed: Dec. 19, 1994

[51] Int. Cl.[6] ..... B65H 29/16; B65H 29/28

[52] U.S. Cl. ..... 271/193; 198/690.1

[58] Field of Search ..... 271/18.1, 193, 271/198, 275; 198/690.1

[56] References Cited

U.S. PATENT DOCUMENTS

| | | | |
|---|---|---|---|
| 2,576,882 | 11/1951 | Koole et al. . | |
| 3,194,131 | 9/1965 | Robinson . | |
| 3,332,328 | 7/1967 | Roth, Jr. . | |
| 3,357,325 | 12/1967 | Eichorn et al. . | |
| 3,634,740 | 1/1972 | Stevko . | |
| 3,642,362 | 2/1972 | Mueller . | |
| 3,644,034 | 2/1972 | Nelson . | |
| 3,690,646 | 9/1972 | Kolibas . | |
| 3,717,801 | 2/1973 | Silverberg . | |
| 3,765,757 | 10/1973 | Weigl . | |
| 3,976,370 | 8/1976 | Goel et al. | 355/3 R |
| 4,244,465 | 1/1981 | Hishikawa et al. | 271/193 X |
| 4,526,357 | 7/1985 | Kuehnle et al. | 271/193 X |
| 4,856,769 | 8/1989 | Andrew et al. | 271/193 |
| 4,864,461 | 9/1989 | Kasahara | 271/193 X |
| 5,003,325 | 3/1991 | Bibl | 271/18.1 X |
| 5,121,170 | 6/1992 | Bannai et al. | 271/275 X |

FOREIGN PATENT DOCUMENTS

| | | | |
|---|---|---|---|
| 3-23130 | 1/1991 | Japan | 271/193 |
| 3152035 | 6/1991 | Japan | 271/193 |
| 3177242 | 8/1991 | Japan | 271/193 |
| 4-72236 | 3/1992 | Japan | 271/193 |

*Primary Examiner*—David A. Bucci
*Assistant Examiner*—Scott L. Lowe
*Attorney, Agent, or Firm*—Lloyd F. Bean, II

[57] ABSTRACT

A sheet handling system has an endless transporting and supporting belt for transporting sheet along a path. The belt includes a ferroelectric material layer for generating an electrostatic force on the surface thereof to retain the sheet.

18 Claims, 3 Drawing Sheets

SELF BIASING ELECTROSTATIC PAPER TRANSPORT

The present invention relates to an electrostatographic copying system in which the copy sheets are transported on a belt through both the transfer and fusing sub-systems for improved sheet handling and reliability.

The accurate and reliable transport of copy sheets, particularly cut paper through the work stations of electrostatographic copying systems is a particular problem due to the highly variable nature of such materials. "Paper jams" are one of the main causes of copying machine shut-downs. Various sheet transporting devices, such as mechanical grippers, vacuum and other transport belts, feed rollers, wire guides, charged photoreceptors, etc., are well known. Generally several different transport systems are utilized, and the sheets must be transferred between them. Each such sheet transfer adds a potential jam area, especially if the sheet has a pre-set curl. Both the transfer and fusing work stations have particular sheet handling problems because of electrical and thermal and pressure effects on the sheet.

It is generally known that a copy sheet can be transported on a belt or other member on which it is held by an electrostatic charge pattern. The following U.S. Pat. Nos. are exemplary of this art: 3,976,370 to Goel et al.; 2,576,882 to P. Koole et al.; 3,357,325 to R. H. Eichorn et al.; 3,642,362 to D. Mueller; 3,690,646 to J. A. Kolibas; 3,717,801 to M. Silverberg; and 3,765,757 to J. Weigl (electrostatic original document detention is disclosed in 3,194,131 and 3,634,740).

In a conventional transfer station in electrostatography, toner (image developer material) is transferred from the photoreceptor (the original support and imaging surface) to the copy paper (the final support surface). The toner is then fixed to the copy sheet, typically in a subsequent thermal fusing station.

A particular copy sheet transport problem is the accurate and positive transporting of sheets into, through, and out of a xerographic or other electrostatographic transfer station. The copy sheet must be maintained in accurate registration with the toner image to be transferred. The transfer electrostatic fields and transfer contact pressure are critical for good transferred image quality. Further, the sheet typically acquires a tacking charge and the imaging surface has a charge on it as well. Thus, the copy sheet must be either mechanically or electrostatically stripped (separated) from the imaging surface at the exit of the transfer station or process, yet without disrupting the transferred image which is typically unfused at that point and easily disturbed by either mechanical or electrical forces.

It may be seen that it is desirable to fully support and positively retain the copy sheet on the same transport through the entire transfer station, particularly including the removal of the sheet from the imaging surface. The present invention provides electrostatic means for continuously positively retaining a copy sheet, including its passage through a transfer station, on a single moving belt surface. Thus, the present system does not require a vacuum sheet retaining system, although it will be appreciated that a vacuum may be additionally applied in combination therewith if so desired.

Considering particularly references to prior transfer belt systems, U.S. Pat. No. 3,332,328, issued Jul. 25, 1967, to C. F. Roth, Jr., discloses a xerographic transfer station including an endless loop belt for carrying the copy sheets through the transfer station, including contact with the xerographic drum, and corona charging means for placing a transfer charge on the back of the endless transfer belt.

U.S. Pat. No. 3,357,325, issued Dec. 12, 1967, to R. H. Eichorn et al., also contains these same basic features, plus additional D.C. corona charging means to charge the sheet of copy paper on the belt prior to transfer, so as to hold the paper on the belt electrostatically. It should be noted, however, that the charging of the paper (or belt) in this manner contributes to the total transfer potential, which is generally undesirable unless this additional charge can be held constant. A transfer corona generator is tilted relative to the back of the belt to provide the Eichorn transfer field.

U.S. Pat. No. 3,644,034, issued Feb. 22, 1972, to R. L. Nelson discloses a segmented wide conductive strip transfer belt to which two different bias potentials are applied by two support rollers to those segments passing over the rollers. The conductive segments are separated by 1/16 inch insulative segments.

Hereinbefore sheet handling systems in which a copy sheet can be transported on a belt or other member on which it is held by an electrostatic charge pattern have required sources of power to generate the necessary electrostatic charge pattern. This need was met by employing costly and heavy power supplies. A simple, relatively inexpensive, and accurate approach to eliminate the expense and weight of traditional high voltage sources in such printing systems has been a goal in the design, manufacture and use of electrophotographic printers. The need to provide accurate and inexpensive sheet handling systems has become more acute, as the demand for high quality, relatively inexpensive electrophotographic printers has increased.

SUMMARY OF INVENTION

In accordance with one aspect of the present invention, there is provided a sheet handling apparatus for transporting a sheet along a path, including a flexible member and a ferroelectric polymer material layer associated with the flexible member for generating an electrostatic force on a surface thereof to retain the sheet on the flexible member.

In accordance with another aspect of the present invention, there is provided a printing machine of the type having a sheet transport for moving a sheet along a path to selected processing stations therein, including a flexible member and a ferroelectric polymer material layer associated with the flexible member for generating an electrostatic force on a surface thereof to retain the sheet on the surface of the flexible member.

BRIEF DESCRIPTION OF THE DRAWINGS

These and other aspects of the present invention will become apparent from the following description in conjunction with the accompanying drawings in which.

DETAILED EMBODIMENT

As indicated hereinabove, the present invention provides a novel document handling system for use in an electrostatographic printing machine. While the present invention will be described with reference to a preferred embodiment thereof, it will be understood that the invention is not limited to this preferred embodiment. On the contrary, it is intended that the present invention cover all alternatives, modifications, and equivalents as may be included within the spirit and scope of the invention as defined by the appended claims. Other aspects and features of the present invention will become apparent as the description proceeds.

Figure 1:
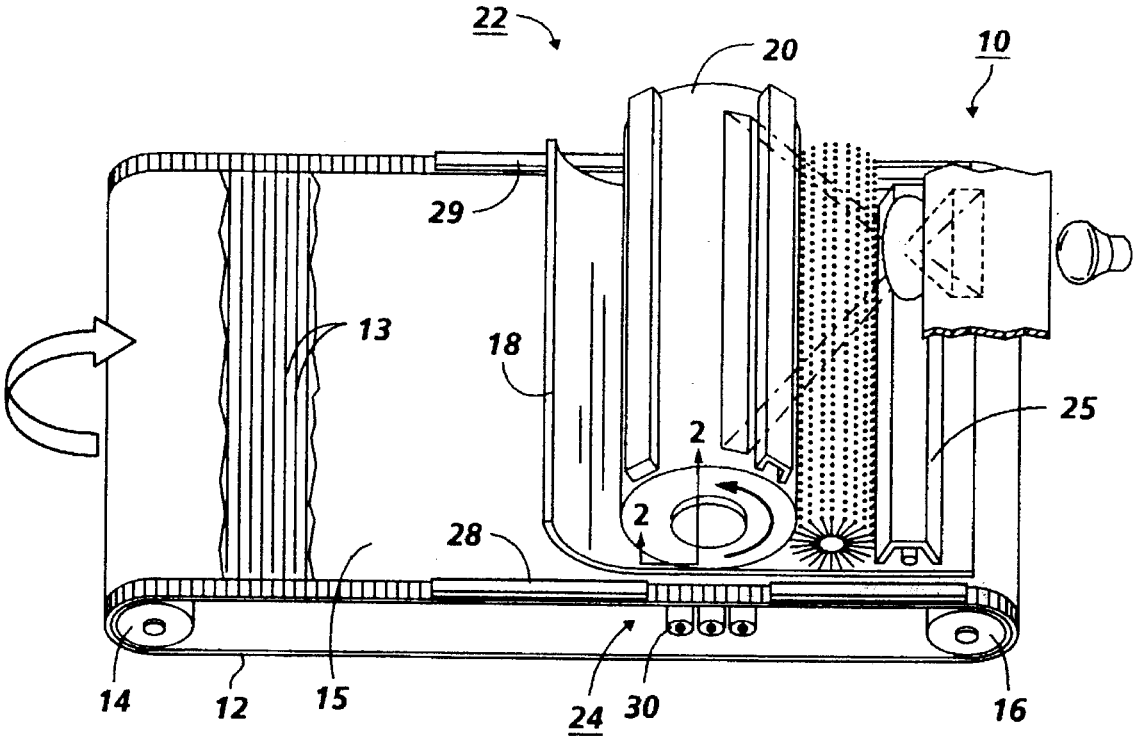
FIG. 1 is a schematic perspective view of an exemplary electrostatic belt transport in accordance with the present invention in xerographic copy system.

Referring to FIG. 1, there is schematically shown a belt transfer and fusing system 10 as an exemplary embodiment of the present invention. Since various details thereof are well known and fully described in the above-cited and other references relating to copy sheet handling, transfer, fusing and xerography in general, those conventional details, for improved clarity, will not be described herein.

The system 10 here comprises a copy sheet transport belt 12 which is supported and rotatably driven between rollers 14 and 16. The transport belt 12 is preferably constructed with a layer of a piezoelectric polymer film, such as polyvinylidene fluoride (PVDF) film, preferably Kynar® film manufactured by Pennwalt KTM. Transport belt 12 may include an additional "relaxable," semi-conductive backing layer, or conductive coating.

Figure 4:
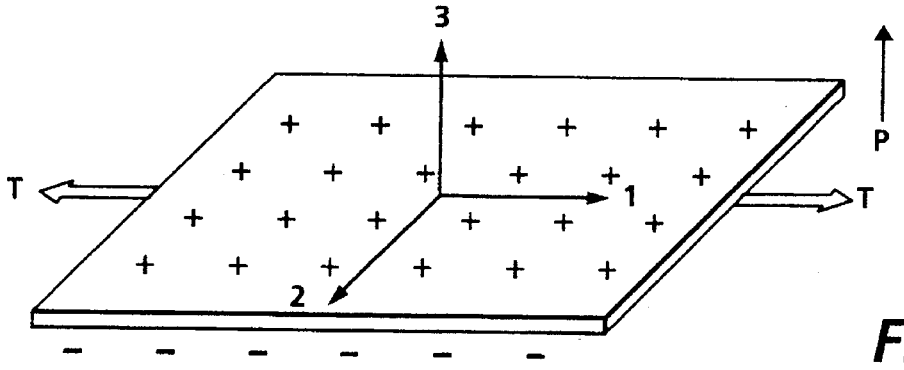
FIG. 4 is a perspective view illustrating the geometry of a piezoelectric sheet.

PVDF materials are formed by stretching the film in one direction, and applying a large electric field to electrically polarize it in a direction perpendicular to the film. In FIG. 4, the stretch direction is denoted by "1" and the polarization direction is denoted by "3". When a PVDF sheet is strained, it develops an internal electric field which is proportional to the deformation.

Figure 5:
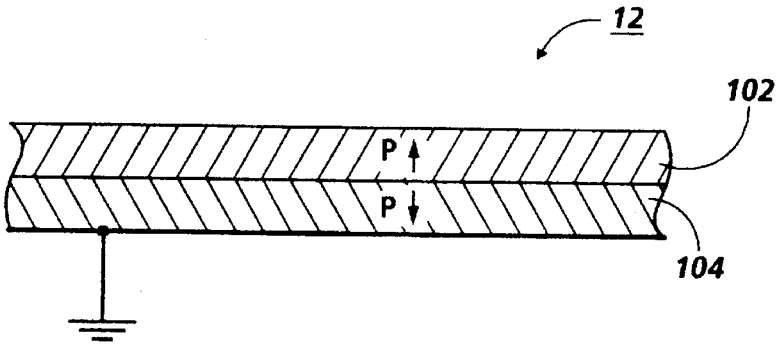
FIG. 5 is an elevational view illustrating a (bimorph) Xeromorph sheet which is utilized by the present invention.
Figure 6:
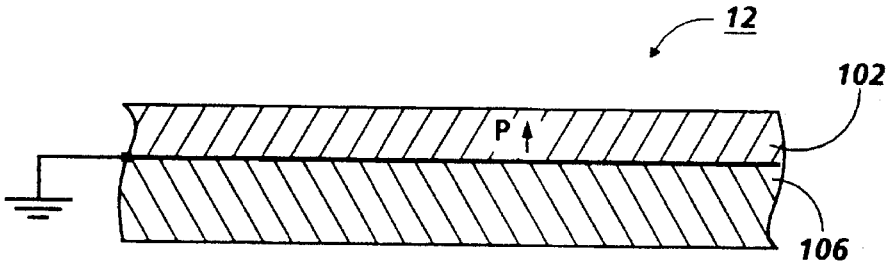
FIG. 6 is an elevational view illustrating a (unimorph) Xeromorph sheet which is utilized by the present invention.

The present invention utilizes either a bimorph or a unimorph structure referred to as a "Xeromorph ". A bimorph Xeromorph consists of two PVDF sheets 102 and 104 laminated together with each sheet polarization direction opposed to each other having only a bottom electrode, as shown in FIG. 5. A unimorph Xeromorph consists of a single PVDF sheet 102 laminated to a thick substrate 106 as shown in FIG. 6. The substrate material may comprise materials which can be bent, and have no piezoelectric properties.

The piezoelectric polymer film layer of belt 12 has-a very fine (closely adjacent) pattern of varying or alternately electrically polarized stripes 13 extending linearly perpendicular or parallel to the direction of belt movement. These polarized stripes 13 may be created within the piezoelectric polymer film layer of belt 12 by polarizing selected stripes while leaving other stripes unpolarized or by applying spatially varying poling fields which result in stripes of one polarity being adjacent to a stripe having a reverse polarity. The belt 12 is preferably protectively overcoated by a thin dielectric layer 15 as shown. This outer layer 15 here is preferably white (reflective) to avoid heat pick-up from the radiant fuser. Teflon (tetrafluoroethylene) or Kel-F or high temperate resistant silicone rubber are appropriate materials.

The copy sheet transport belt 12 positively supports, holds and carries the copy sheet 18 into and out of contact with an imaging surface 20 of a xerographic copying system 22 at a transfer station 24, and then through a conventional radiant fuser 25. The xerographic copying system 22 shown here also schematically includes the conventional stations, in order, for cleaning, charging, optical imaging and toner development of the imaging surface 20.

As transport belt 12 deforms around the radius of roller 14 an electric potential is generated on the surface of belt 12. The transport belt 12, by an electrostatic fringe field charge pattern generated by polarize stripes 13 provides positive retention of the copy sheet 18 at all desired points along the path of the transport belt 12, until it is desired to strip the copy sheet therefrom by any suitable conventional sheet stripping means.

Figure 2:
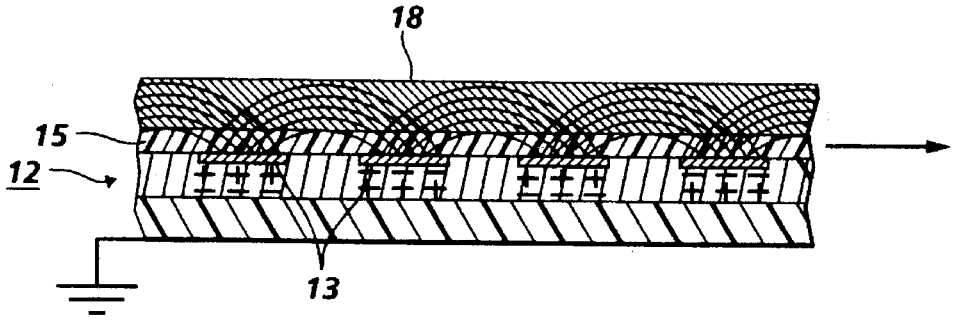
FIG. 2 is a magnified cross sectional view of an exemplary electrostatic belt in accordance with the present invention of FIG. 1.

A highly desired feature of the electrostatic paper tacking pattern formed on the belt is that the adjacent polarized stripes are sufficiently closely spaced, i.e., sufficiently fine, to form a very fine fringe field electrostatic pattern. Preferably the spacing between stripes is not substantially greater than the thickness of the copy sheet or not greater than the thickness of the copy sheet plus the intervening belt material thickness if that is substantial. Such close or fine spacing will cause the fringe fields to extend primarily inside the copy sheet from the supported back surface thereof, and not extend appreciably outside of the front, or image-receiving, surface of the copy sheet. Note FIG. 2 in this regard. For most conventional copy sheet thicknesses the preferred polarized pattern is thus approximately 0.13 millimeters (5 mils) in spacing between the polarized areas. While for most substrates it is a preferred mode to utilize a varied surface potential to produce the fringing fields, for some substrates sufficient electrostatic tacking force can be had with a uniform surface potential. Particularly for lightweight papers, the uniform electrostatic fields created with a uniform surface potential on the ferroelectric polymer layer would provide adequate normal force for transport.

It will be noted that the adjacent polarized stripes of the transport belt 12 do not have to generate an opposite polarity surface potential. One can be grounded, or both can be of the same polarity, but different levels. For paper tacking it is only necessary that adjacent polarized stripes be charged or discharged to a substantially different, i.e., higher or lower, voltage level than so as to create fringe fields of appropriate intensity for retention of the particular copy sheets.

Paper stripping is accomplished at the sharp radius turn due to the beam strength of the paper. A grounding contact may be provided for in the area of similar strain induction as that of the desired stripping area to remove all tacking charges from the belt to enhance stripping in the intended stripping region.

Figure 3:
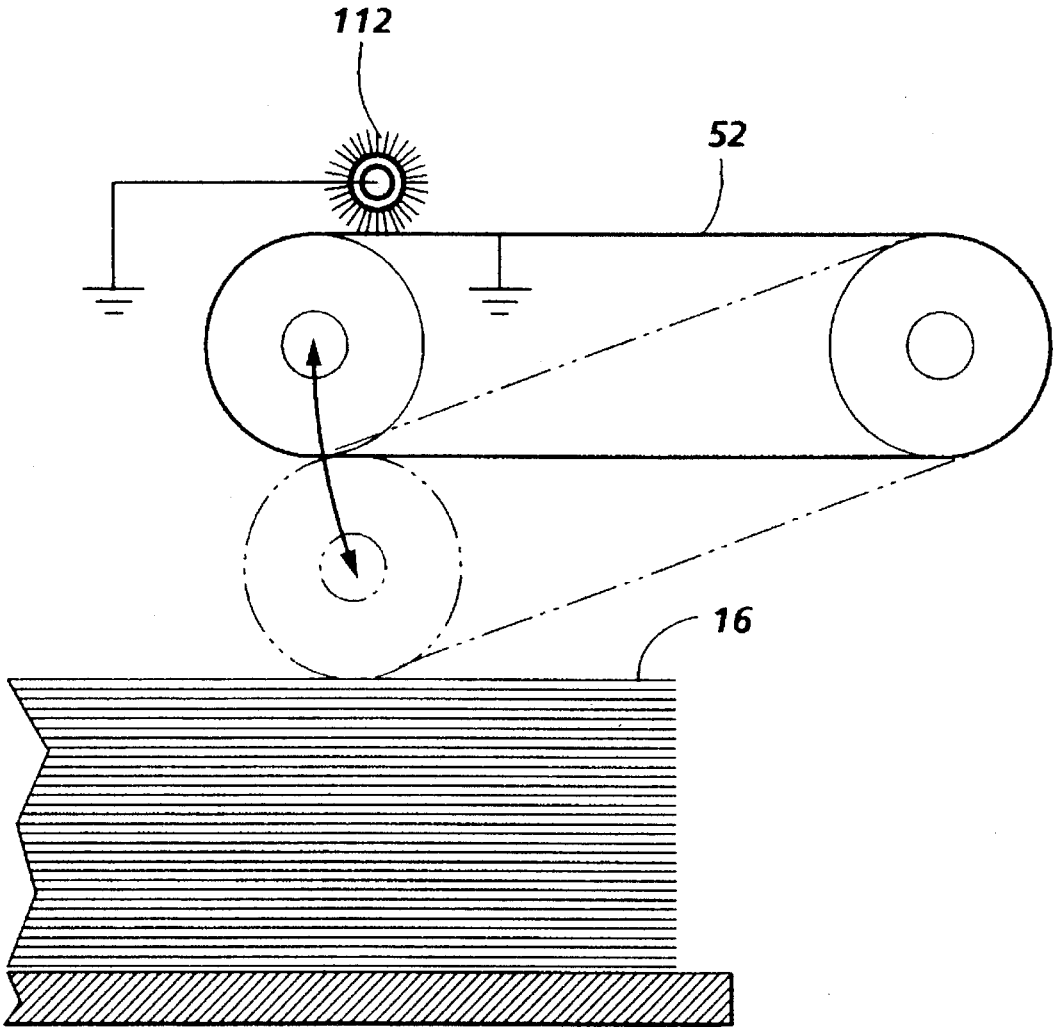
FIG. 3 is another embodiment of the present invention.

Considering now the embodiment of FIG. 3, it may be seen that it has a belt 52 similar in construct and function to the belt 12 as described above. Belt 52 differs in that the belt has a uniform polarization. A camming mechanism (not shown) brings the paper transport in contact with a stack of paper sheets. A coarse neutralization brush 112 serves to spatially randomized the surface potential of belt 52 thereby providing positive retention of the copy sheet 18 at all desired points along the path of the transport belt 52, until it is desired to strip the copy sheet therefrom by any suitable conventional sheet stripping means.

An alternative approach to achieve the spatially varying surface potentials necessary for the electrostatic paper tacking function is to induce localized strain variations of the piezoelectric layer. This may be performed with, for example, a bumpy roll which will induce variable strains of the piezoelectric polymer layer as the belt rotates over this roll.

It should be evident that the present invention could employ pyroelectric material instead of piezoelectric material for producing a patterned electrostatic charge on the transport belt. For example a heater could be employed instead of roller to induce the formation of an electrostatic charge on the surface of the transport belt. To achieve similarly varying surface potentials as previously described this approach may be employed applying a combination of uniform or nonuniform polymer polarization, uniform or nonuniform, heating, and/or uniform or nonuniform surface neutralization.

It is, therefore, evident that there has been provided, in accordance, with the present invention, a self-biasable electrostatic paper transport that fully satisfies the aims and advantages of the invention as hereinabove set forth. While the invention has been described in conjunction with preferred embodiments thereof, it is evident that many alternatives, modifications, and variations may be apparent to those skilled in the art. Accordingly, the present application for patent is intended to embrace all such alternatives, modifications, and variations as are within the broad scope and spirit of the appended claims.

We claim:

1. A sheet handling apparatus for transporting a sheet along a path, comprising:

a flexible member; and a ferroelectric material layer associated with said flexible member for generating an electrostatic force on a surface thereof to retain the sheet on said flexible member, said ferroelectric material layer comprises a piezoelectric material layer that generates the electrostatic force in response to being deformed.

2. The apparatus of claim 1, wherein said piezoelectric material layer comprises:

a first layer of piezoelectric polymer film having a first polarization direction; and a second layer of piezoelectric polymer film having a second polarization direction opposed to the first polarization direction.

3. The apparatus of claim 1, wherein said flexible member comprises a belt.

4. The apparatus of claim 3, further comprising means for spatially randomizing the electrostatic force on a surface of the belt to provide positive retention of the sheet.

5. The apparatus of claim 4, wherein said randomizing means comprises a brush for neutralizing portions of the electrostatic force on said surface of said belt.

6. The apparatus of claim 4, wherein said randomizing means comprises a pattern of polarized stripes in said belt extending in a transverse direction to the path.

7. The apparatus of claim 6, further comprising a pattern of non-polarized stripes with a non-polarized stripe being interposed between adjacent polarized stripes.

8. The apparatus of claim 6, further comprising a pattern of reversed polarized stripes with a reversed polarized stripe being interposed between adjacent polarized stripes.

9. A sheet handling apparatus for transporting a sheet along a path, comprising:

a flexible member; and a ferroelectric material layer associated with said flexible member for generating an electrostatic force on a surface thereof to retain the sheet on said flexible member, said ferroelectric material layer comprises a pyroelectric material layer that generates the electrostatic force in response to being heated.

10. A printing machine of the type having a sheet transport for moving a sheet along a path to selected processing stations therein, comprising:

a flexible member; and a ferroelectric material layer associated with said flexible member for generating an electrostatic force on a surface thereof to retain the sheet on said flexible member, said ferroelectric material layer comprises a piezoelectric material layer that generates the electrostatic force in response to being deformed.

11. The apparatus of claim 10, wherein said piezoelectric material layer comprises:

a first layer of piezoelectric polymer film having a first polarization direction; and a second layer of piezoelectric polymer film having a second polarization direction opposed to the first polarization direction.

12. The apparatus of claim 10, wherein said flexible member comprises a belt.

13. The apparatus of claim 12, further comprising means for spatially randomizing the electrostatic force on a surface of the belt to provide positive retention of the sheet.

14. The apparatus of claim 13, wherein said randomizing means comprises a brush for neutralizing portions of the electrostatic force on said surface of said belt.

15. The apparatus of claim 13, wherein said randomizing means comprises a pattern of polarized stripes in said belt extending in a transverse direction to the path.

16. The apparatus of claim 15, further comprising a pattern of non-polarized stripes with a non-polarized stripe being interposed between adjacent polarized stripes.

17. The apparatus of claim 15, further comprising a pattern of reversed polarized stripes with a reversed polarized stripe being interposed between adjacent polarized stripes.

18. A printing machine of the type having a sheet transport for moving a sheet along a path to selected processing stations therein, comprising:

a flexible member; and a ferroelectric material layer associated with said flexible member for generating an electrostatic force on a surface thereof to retain the sheet on said flexible member, said ferroelectric material layer comprises a pyroelectric material layer that generates the electrostatic force in response to being heated.

* * * * *